US011691654B2

(12) United States Patent
Hirose

(10) Patent No.: US 11,691,654 B2
(45) Date of Patent: Jul. 4, 2023

(54) CABLEWAY CARRIAGE

(71) Applicant: MORINOKIKAI CO., Ltd., Seki (JP)

(72) Inventor: Yukiyasu Hirose, Seki (JP)

(73) Assignee: MORINOKIKAI CO., Ltd., Seki (JP)

( * ) Notice: Subject to any disclaimer, the term of this patent is extended or adjusted under 35 U.S.C. 154(b) by 532 days.

(21) Appl. No.: 16/977,211

(22) PCT Filed: Feb. 18, 2019

(86) PCT No.: PCT/JP2019/005838
§ 371 (c)(1),
(2) Date: Sep. 1, 2020

(87) PCT Pub. No.: WO2019/176456
PCT Pub. Date: Sep. 19, 2019

(65) Prior Publication Data

US 2021/0039690 A1 Feb. 11, 2021

(30) Foreign Application Priority Data

Mar. 16, 2018 (JP) ..... 2018-048911

(51) Int. Cl.
*B61H 9/02* (2006.01)
*B61B 7/02* (2006.01)
(Continued)

(52) U.S. Cl.
CPC ..... *B61H 9/02* (2013.01); *B61B 7/02* (2013.01); *B61B 12/122* (2013.01); *B66C 21/00* (2013.01)

(58) Field of Classification Search
CPC .... B61H 9/00; B61H 9/02; B61H 9/04; B61B 7/00; B61B 7/02; B61B 7/04;
(Continued)

(56) References Cited

U.S. PATENT DOCUMENTS 690,660 A * 1/1902 Ney ..... B66C 21/00 212/114
1,599,456 A * 9/1926 Burks ..... B66C 21/00 212/91
(Continued)

FOREIGN PATENT DOCUMENTS

AT 396918 B * 11/1993 ..... B66C 21/00
CN 103818830 A * 5/2014 ..... B66C 11/22
(Continued)

*Primary Examiner* — S. Joseph Morano
*Assistant Examiner* — Cheng Lin
(74) *Attorney, Agent, or Firm* — Kenichiro Yoshida

(57) ABSTRACT

A cableway carriage including: a base member 1; a main cable braking member 10 that has a braking face that comes into contact with the main cable and that is secured to the base member; a first lever 20 that has a first fulcrum serving as a center of rotation and secured to the base member, a first lever braking face provided in a position facing the braking face, a biasing member that biases the first lever braking face in a direction of separation from the braking face, and a drive pulley capable of applying a force in the direction in which the first lever braking face is brought close to the braking face by the tensile force of the rope, and a second lever 30 that has a second fulcrum secured to the base member and serving as a center of rotation.

8 Claims, 8 Drawing Sheets

(51) Int. Cl.
*B61B 12/12* (2006.01)
*B66C 21/00* (2006.01)

(58) Field of Classification Search
CPC ..... B61B 7/045; B61B 12/00; B61B 12/12; B61B 12/122; B61B 12/127; B66C 11/20; B66C 11/24; B66C 21/00; B66C 21/10; A63G 21/22
See application file for complete search history.

(56) References Cited

U.S. PATENT DOCUMENTS 4,125,919 A * 11/1978 Dumont ..... B66C 21/00 403/374.2
4,238,038 A * 12/1980 Fikse ..... A01G 23/003 104/178
8,333,155 B2 * 12/2012 Cylvick ..... A63G 21/20 104/112
8,708,109 B2 * 4/2014 Steele ..... B61B 12/105 188/65.2
10,023,208 B2 * 7/2018 Brown ..... B61H 9/04

FOREIGN PATENT DOCUMENTS

CN 203740909 U * 7/2014 ..... B66C 21/10
DE 233277 A3 * 2/1986 ..... B66C 11/24
DE 10229554 A1 * 1/2004 ..... B66C 21/00
EP 0262372 A2 * 4/1988 ..... B66C 11/20

* cited by examiner

CABLEWAY CARRIAGE

TECHNICAL FIELD

The present invention relates to a cableway carriage.

BACKGROUND ART

Cableway carriages are used for the yarding of cut lumber. Cableway carriages include the type that performs carriage by way of aerial lifting (Patent Literature 1) and the type that performs carriage through skidding (Patent Literature 2). In the case of the type that performs carriage through skidding, a cableway carriage of the so-called single-drum type, where the carriage is made to move using a single winch, is subject to the following problems.

For example, when lifting a load, there is the problem that the cableway carriage then moves in the direction in which the wire rope is pulled before the end of the lumber rises. When the cableway carriage moves thus in the driven direction, it becomes difficult for a force to act in the direction in which the end of the lumber is made to float, and when there is an obstacle such as a rock or a stump in particular, the problem then arises that the lumber can no longer be moved without getting past the obstacle. When the wire rope is pulled forcibly using a winch starting from this state, the tensile force is then high, and hence there is the problem that when this tensile force exceeds the obstacle, the lumber suddenly flies from the obstacle, which is extremely dangerous.

Meanwhile, lowering a load constitutes a further problem in that, because the cableway itself is on a descending slope, the carriage vigorously slips downward under the weight of the cableway carriage itself and due to the pulling by the winch, which is dangerous, and there is the problem that the end of the lumber does not rise. Furthermore, due to the inclined surface, there is the problem that the lumber slipping downward ahead of the carriage also represents a danger. The steeper the surface, the more dangerous the resulting situation. For this reason, a single-drum cableway carriage has conventionally been unsuitable for use in lowering a load.

CITATIONS LIST

Patent Literature

Patent Literature 1: Japanese Unexamined Patent Publication No. 2016-160036.

Patent Literature 2: Japanese Utility Model Application Publication No. 05-64184.

SUMMARY OF INVENTION

Technical Problems

The present invention was conceived in view of such problems, and an object of the present invention is to provide a single-drum-type cableway carriage that can also be safely used without danger for lumber-yarding which involves either the raising of a load or the lowering of a load over gentle slopes and steep surfaces.

Solutions to Problems

The present invention adopts the following means to achieve the foregoing object.

A cableway carriage according to the present invention is a cableway carriage for carrying a load by utilizing a cableway that has a main cable, and a rope including a trigger, the cableway carriage including:

a base member;

a main cable braking member that has a braking face that comes into contact with the main cable and that is secured to the base member;

a first lever that has a first fulcrum serving as a center of rotation and secured to the base member, a first lever braking face provided in a position facing the braking face, a biasing member that biases the first lever braking face in a direction of separation from the braking face, and a drive pulley capable of applying a force in the direction in which the first lever braking face is brought close to the braking face by the tensile force of the rope, and a second lever that has a second fulcrum secured to the base member and serving as a center of rotation, and a first lever pressing part capable of pressing the first lever in the direction in which the first lever braking face is separated from the braking face, wherein, when the trigger, which indicates that the load has reached a predetermined height, presses the second lever, the second lever causes the first lever to separate the first lever braking face from the braking face.

In the case of the cableway carriage according to the present invention, basically, when a tensile force due to a load is being applied to the rope, as long as the first lever braking face of the first lever is not separated from the braking face as a result of the trigger pressing the second lever upward, that is, as long as an optimal state for lifting and carrying the load has not been assumed, there is no movement of the cableway carriage, thus affording the cableway carriage superior safety and enabling same to be used for either lifting a load or lowering a load. Furthermore, because the cableway carriage is immediately subjected to braking if the load undergoes an operation other than the intended movement caused by driving using the rope, skidding with a superior level of safety can be implemented.

Furthermore, in the cableway carriage according to the present invention, the second lever may have a surface with which the trigger comes into contact that is formed having a convex, curved surface.

By adopting this configuration, it is possible to cause the second lever to apply a force to the first lever to move the first lever braking face in the direction of separation from the braking face, irrespective of whether the direction of the tensile force of the rope due to the load is the travel direction of the cableway carriage or the direction opposite to the travel direction.

Moreover, in the cableway carriage according to the present invention, at least a portion of the second lever may be formed as two parallel plates between which the first lever is arranged in an intersecting manner.

By adopting this configuration, the likelihood of the first and second levers twisting can be reduced. Furthermore, the likelihood of the intersecting state between the first and second levers being released can be reduced.

Moreover, in the cableway carriage according to the present invention, at least a portion of the second lever may be formed as two parallel plates between which the rope is arranged.

By adopting this configuration, a trigger attached to the rope is capable of reliably pressing the second lever upward.

In addition, in the cableway carriage according to the present invention, the second lever may be configured such that a moving member for preventing the rope from disengaging from the second lever is slidably attached in the longitudinal direction of the second lever.

By adopting this configuration, the rope can be prevented from disengaging from the second lever.

Moreover, in the cableway carriage according to the present invention, the braking face may be provided to a member that is exchangeable for the main cable braking member.

By adopting this configuration, the braking face can be easily exchanged even when worn.

Moreover, in the cableway carriage according to the present invention, the first lever braking face may be provided to a member that is exchangeable for the first lever.

By adopting this configuration, the first lever braking face can be easily exchanged even when worn.

In addition, in the cableway carriage according to the present invention, below the drive pulley, a correction base pulley that, even when the rope is driven by a load in a direction opposite to the travel direction, corrects the line of the rope with respect to the drive pulley to the direction in which force is applied to the first lever in the direction in which the first lever braking face is brought close from the braking face, may be included.

By adopting this configuration, even in a case where the rope is pulled in either the travel direction or in the direction opposite to the travel direction, a force can be applied to the first lever in the direction in which the first lever braking face is brought close from the braking face, thereby enabling reliable braking.

DESCRIPTION OF EMBODIMENTS

Figure 1:
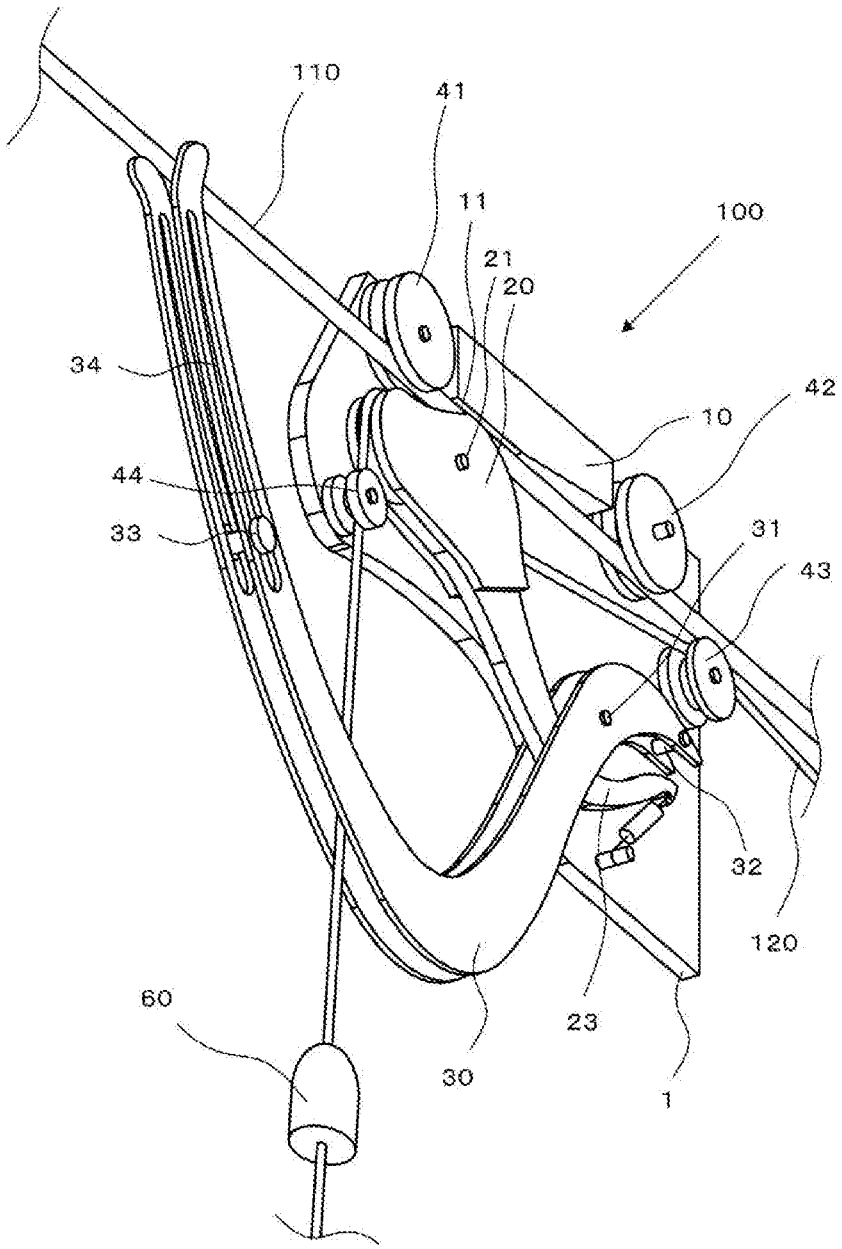
FIG. 1 is a perspective view of a cableway carriage 100 according to the present embodiment.
Figure 2:
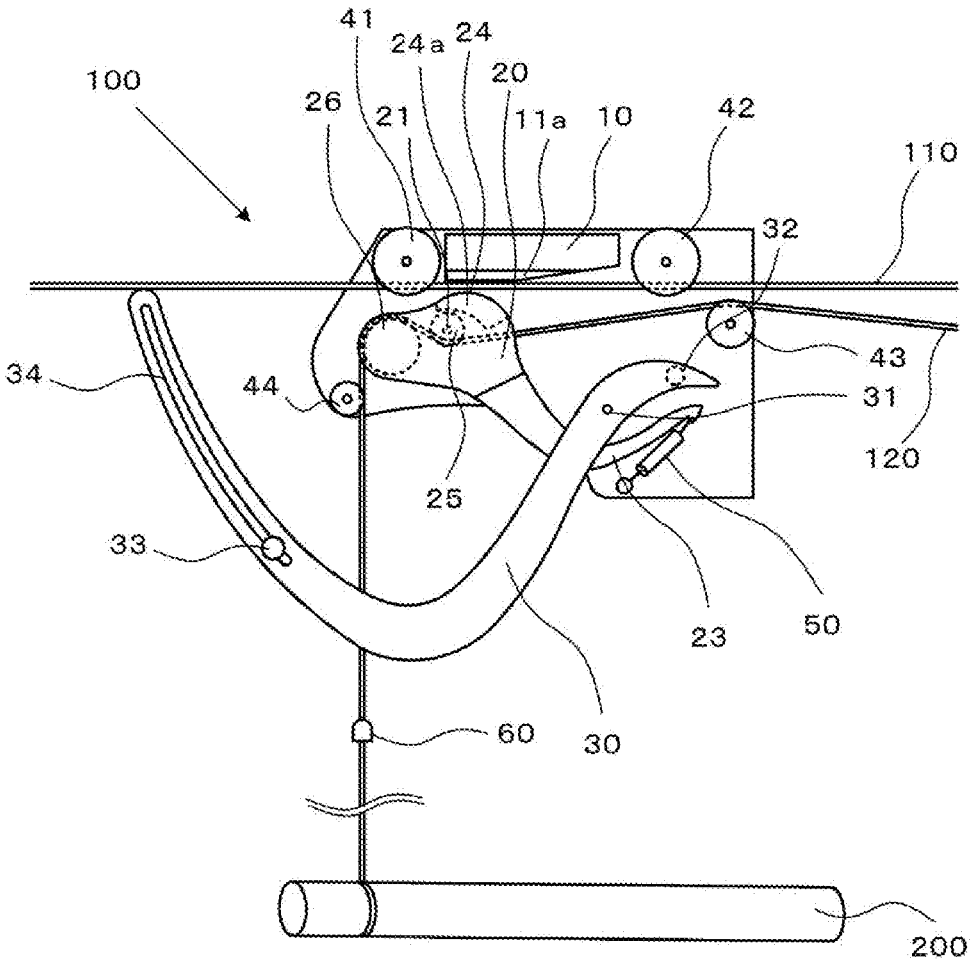
FIG. 2 is a front elevation of the cableway carriage 100 according to the present embodiment.

A cableway carriage 100 according to the present invention will be described in detail in conjunction with the drawings. FIG. 1 is a perspective view of the cableway carriage 100 according to the present embodiment, and FIG. 2 is a front elevation of the cableway carriage 100 according to the present embodiment.

The cableway carriage 100 according to the present invention uses a cableway that includes a main cable 110 that suspends the cableway carriage 100 and a rope (including wire) 120 that moves the cableway carriage 100, and is used as a single-drum type cableway carriage for controlling movement by means of a single winch. The cableway carriage 100 is particularly suitable for yarding cut lumber as a load by means of skidding.

As illustrated in FIG. 1, the cableway carriage 100 according to the present invention mainly includes a base member 1, a main cable braking member 10 that is attached to the base member 1, a first lever 20 that presses the main cable 110 against the main cable braking member 10 in response to the tensile force of a rope 120, a second lever 30 that moves the first lever 20 by means of a trigger 60 which is attached to the rope 120, and a plurality of base pulleys (41 to 44) that guide the main cable 110 and the rope 120. Note that, for the sake of expediency, a state where a rightward direction in FIG. 2 is used as the travel direction in arrangement is described in the present embodiment by way of an example.

The base member 1 is formed from a highly rigid plate such as an iron plate and is a member for securing the main cable braking member 10, the first lever 20, the second lever 30, and the base pulley 41, and the like, but there are no particular limitations on the form of the base member 1.

The main cable braking member 10 is a member that is disposed adjacent to the main cable 110, and because the main cable 110 is sandwiched between the main cable braking member 10 and the first lever 20, the relative position of the cableway carriage 100 with respect to the main cable 110 is secured. In the present embodiment, a surface that includes a block-shaped mass and lies opposite the main cable 110 forms a braking face 11. The braking face 11 is disposed in a position in which a slight gap from the main cable 110 is formed, in a state enabling movement of the cableway carriage 100, that is, in a state where force from the cableway carriage 100 is not applied to the main cable 110. Because the braking face 11 comes to be worn away through abrasion, a braking face part 11*a* may be removably provided using a bolt or the like to the main cable braking member 10 as illustrated in FIG. 2, or may be provided embedded so as to be exchangeable.

The first lever 20 is disposed on the opposite side from the main cable braking member 10, with the main cable 110 interposed therebetween, and has a function for securing the cableway carriage 100 to the main cable 110 by sandwiching the main cable 110 together with the main cable braking member 10. As illustrated in FIG. 2, the first lever 20 has a first fulcrum 21 that is disposed in the direction opposite to the travel direction with respect to the braking face 11, that is, disposed to the left of the braking face 11, and the first lever 20 is capable of turning about the first fulcrum 21. A first pulley 25 for the rope 120 is provided to the first fulcrum 21. Furthermore, a drive pulley 26 for the rope 120 is provided to the left of the first fulcrum 21 of the first lever 20. A bow-shaped part 23 formed with a bow shape is formed on the travel direction side of the first fulcrum 21, and a biasing member 50 such as a spring is provided at the tip of the bow-shaped part 23 to establish a bias in a clockwise rotation direction about the first fulcrum 21. To the right of the first fulcrum 21 and on an upper surface side, a first lever braking face 24 is formed on the part in which the first lever 20 makes contact with the main cable 110 upon rotating counterclockwise. Because the first lever braking face 24 comes to be worn through abrasion like the braking face 11, a first lever braking face part 24*a* that similarly has the first lever braking face 24 may be exchangeably provided, as illustrated in FIG. 2. In the present embodiment, at least a portion of the bow-shaped part 23 of the first lever 20 is formed thinner than the other parts, as illustrated in FIG. 1. The part where the first pulley 25 and the drive pulley 26 are located is fabricated from two parallel plates between which the first pulley 25 and the drive pulley 26 are arranged. By adopting this configuration, the strength of the first lever 20 can be enhanced. Furthermore, the likelihood of the rope 120 disengaging from the first lever 20 can be reduced by passing the rope 120 between the two parallel plates. However, an embodiment with two parallel plates is not essential, rather, a pulley or the like may be provided to a single plate.

As illustrated in FIG. 1 or 2, the second lever 30 is formed having a bow shape constituted by a convex, curved surface with which a trigger 60, described subsequently, comes into contact, has a second fulcrum 31 to the right of and below the first fulcrum 21, and is capable of turning about the second fulcrum 31. The second lever 30 is formed having two forked, parallel plates which are spaced apart and secured by a support (not illustrated). The bow-shaped part 23 of the first lever 20 is disposed between the parallel plates. Thus, the first lever 20 and second lever 30 are arranged so as to intersect one another. A first lever pressing part 32 is provided at the right end of the second lever 30 or close to the right end thereof, and the second lever 30 is capable, when rotating clockwise, of pressing down the bow-shaped part 23 of the first lever 20. A groove 34 is formed along the longitudinal direction in the left side of the second lever 30, and a moving member 33 capable of moving in a longitudinal direction along the groove 34 is attached so as to straddle the two plates. Furthermore, the left end of the second lever 30 is formed such that the tips of the parallel plates are open, and when the second lever 30 rotates clockwise by a large amount, the main cable 110 is easily inserted between the parallel plates.

The base pulleys (41 to 44) are pulleys which are directly attached to the base member 1 and which are for guiding the main cable 110 and rope 120. The base pulleys include a first base pulley 41 and a second base pulley 42, which guide the main cable 110, a third base pulley 43 for guiding the rope 120, and a correction base pulley 44 for correcting the direction of the rope 120 with respect to the drive pulley 26. The first base pulley 41 and second base pulley 42 are pulleys for suspending the cableway carriage 100 that are arranged on both sides of the main cable braking member 10 and arranged such that the main cable 110 is slightly below the braking face 11. The third base pulley 43 is disposed to the right of the first fulcrum 21 such that the upper surface of the third base pulley 43 is above the lower surface of the first pulley 25 so that the rope 120 makes contact with the lower surface of the first pulley 25. The correction base pulley 44 is configured so that the tensile force of the rope 120 effectively acts downward with respect to the drive pulley 26 even when the rope 120 is pulled in the direction opposite to the travel direction, and is disposed such that the right side surface of the correction base pulley 44 is located substantially below the left side surface of the drive pulley 26.

Furthermore, a cover for covering the front surface is optionally provided, and a block and a pulley that guide the main cable 110 or the rope 120 may suitably also be provided.

The cableway carriage 100 constituted as above is used as follows. First, as illustrated in FIG. 2, the cableway carriage 100 is disposed such that the first base pulley 41 and the second base pulley 42 are suspended on the main cable 110 and such that the rope 120 passes the upper surface of the third base pulley 43, below the first pulley 25 of the first fulcrum 21, the upper surface and left side surface of the drive pulley 26, and the right side surface of the correction base pulley 44. A load such as lumber 200 is attached to the end of the rope 120. Furthermore, between the second lever 30 of the rope 120 and the lumber 200, a trigger 60 is attached in a position in which the trigger 60 makes contact with the second lever 30 when a first end of the load is hooked on in order to move the lumber 200 and when a movement condition is fulfilled.

When a tensile force is not acting on the rope 120 from the lumber 200 in this state, that is, in a state where the lumber 200 is not completely suspended, the first lever 20 is biased in a clockwise rotation direction by the biasing member 50. For this reason, the first lever braking face 24 is not in contact with the main cable 110 and is not in a state of braking the main cable 110. Hence, the cableway carriage 100 is capable of moving freely along the main cable 110.

Figure 3:
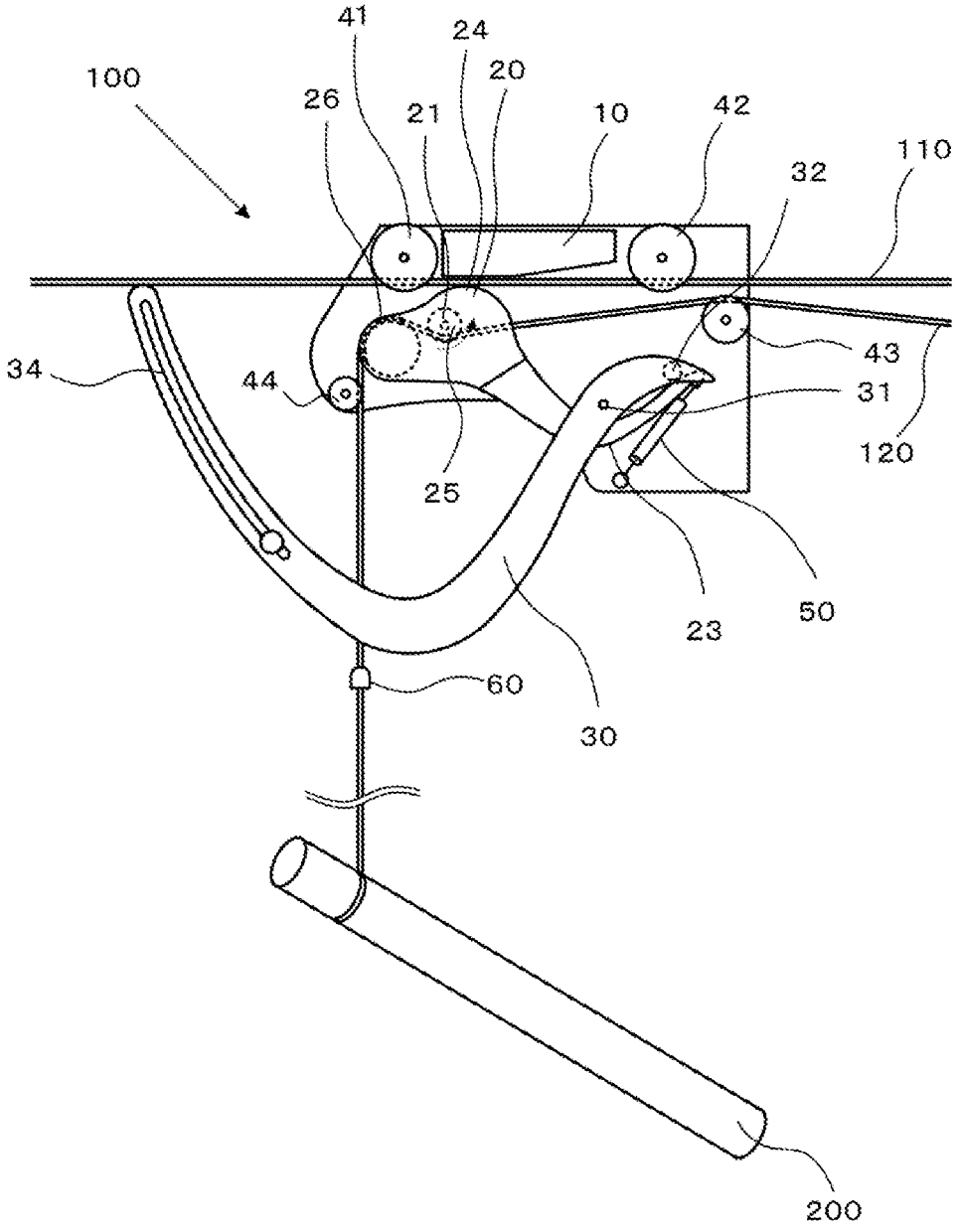
FIG. 3 is a front elevation illustrating movement of the cableway carriage 100 according to the present embodiment.

When the rope 120 is driven from this state and a lifting force is applied to the lumber 200 by the rope 120, the weight W of the lumber 200 then exerts a tensile force T on the rope 120. In this case, weight W=tensile force T. The drive pulley 26 applies a downward force due to the tensile force T applied to the rope 120 and, as indicated by the arrow in FIG. 3, the first lever 20 rotates counterclockwise about the first fulcrum 21. Due to this rotation, the first lever braking face 24 presses the main cable 110 toward the braking face 11 such that the main cable 110 is sandwiched therebetween, thereby securing the cableway carriage 100 on the main cable 110.

When the rope 120 is also driven from this state, the cableway carriage 100 is secured to the main cable 110, and hence the load can be lifted up in a state where the position of the cableway carriage 100 on the main cable 110 is secured rather than the cableway carriage 100 being pulled along as per the prior art.

Figure 4:
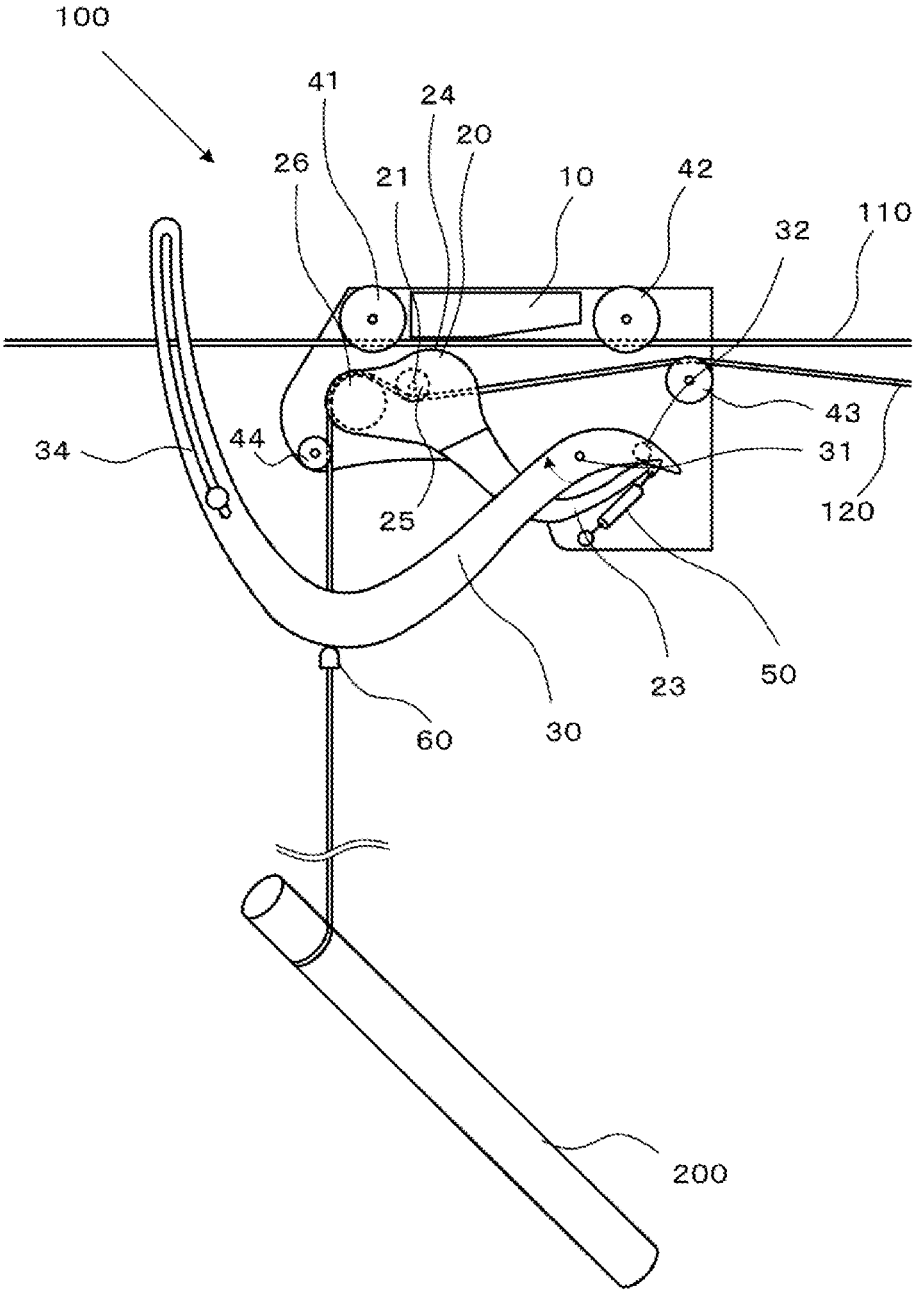
FIG. 4 is a front elevation illustrating movement of the cableway carriage 100 according to the present embodiment.

Furthermore, when the rope 120 is driven from this state, the second lever 30 is then rotated clockwise, as illustrated in FIG. 4, by the trigger 60 attached to the rope 120. Due to the clockwise rotation, the bow-shaped part 23 of the first lever 20 rotates clockwise upon being pressed downward by the first lever pressing part 32, the first lever braking face 24 is released, and the cableway carriage 100 secured to the main cable 110 is then able to move. Hence, when the rope 120 is driven, the cableway carriage 100 then moves together with the lumber 200. The lumber 200 is thus moved to the intended destination.

Figure 5:
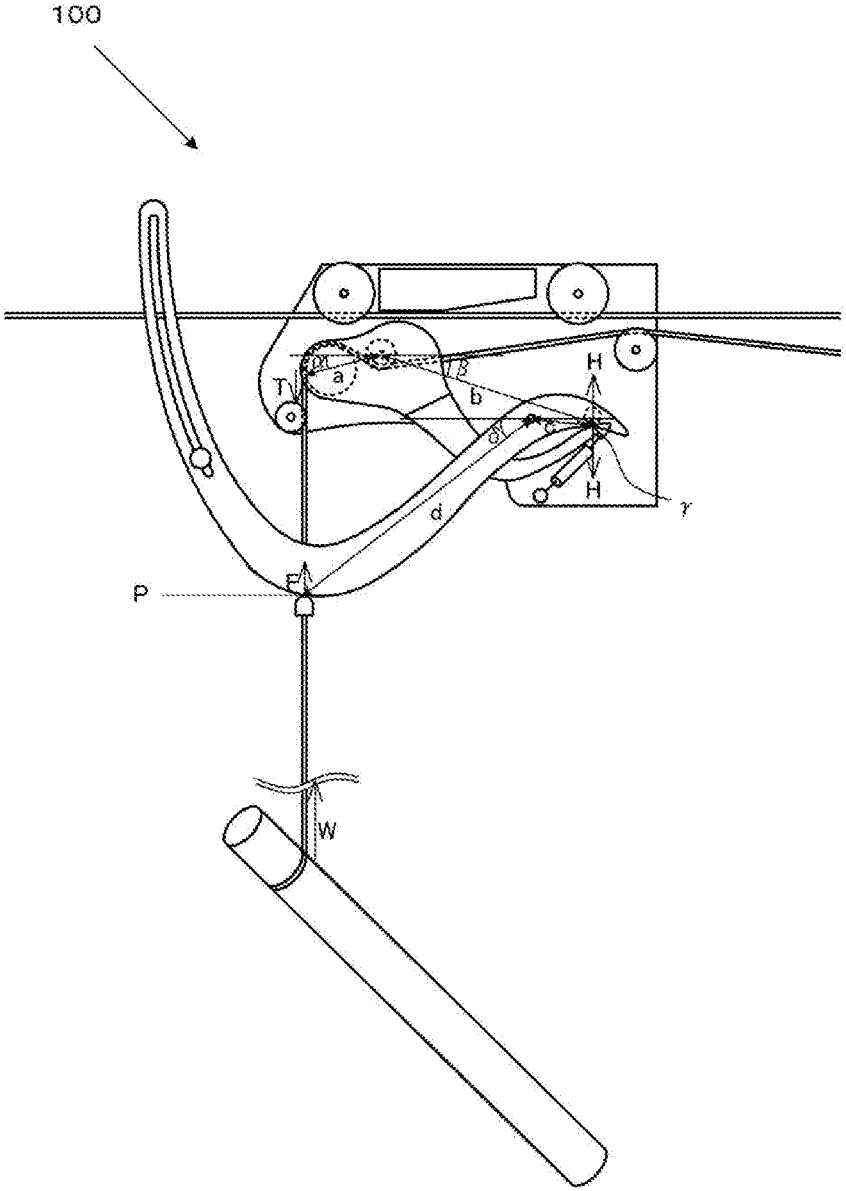
FIG. 5 is an explanatory diagram illustrating a state of equilibrium of the forces on the cableway carriage 100 according to the present embodiment.

The relationships between the forces at such time are as follows. As illustrated in FIG. 5, respectively, in a case where T: the tensile force acting on the rope 120

F: the force with which the second lever 30 is rotated counterclockwise by the trigger 60

H: the drag at the point of contact between the first lever 20 and the second lever 30 a: the distance between the first fulcrum 21 and the point of application of the drive pulley 26 b: the distance between the first fulcrum 21 and the point of application which is the point of contact between the first lever 20 and the second lever 30 c: the distance between the second fulcrum and the point of application which is the point of contact between the first lever 20 and the second lever 30 d: the distance between the second fulcrum and the point of application which is the point of contact between the trigger 60 and the second lever 30

$\alpha$: the angle between a and the main cable $\beta$: the angle between b and the main cable $\gamma$: the angle between c and the main cable, and $\delta$: the angle between d and the main cable, the balance equation for the vertical component of the rotational moment of the first lever 20 is $$T \cdot a \cdot \cos \alpha = H \cdot b \cdot \cos \beta,$$

and the balance equation for the vertical component of the rotational moment of the second lever 30 is $$H \cdot c \cdot \cos \gamma = F \cdot d \cdot \cos \delta.$$

Therefore, the relationship between tensile force T of the rope 120 and the upward pressing force F of the trigger 60 at a braking release starting point P at which, when the rope 120 is driven, the trigger 60 causes the second lever 30 to rotate clockwise and the first lever 20 is made to rotate clockwise via the first lever pressing part 32 (a position in which there is no longer a pressing force from the first lever pressing part 32 due to the pressing force on the second lever 30 from the trigger 60, thereby enabling free movement on the rope; see FIG. 5) is as follows:

$$F = (a \cdot \cos \alpha \times c \cdot \cos \gamma)/(b \cdot \cos \beta \times d \cdot \cos \delta)$$

Thus, when a force exceeding the sum (W+F) of the weight W of the lumber 200 and the upward pressing force F of the trigger 60 is applied to the rope 120, the second lever 30 exceeds the braking release starting point and rises, and the first lever 20 rotates clockwise so as to release the braking face, thereby enabling free movement.

Note that, when a<b at the first lever 20 and c<d at the second lever 30, F can be a smaller force than W. However, α, β, γ, and δ vary according to the rotation of the first lever 20 and second lever 30, and hence, within the range of motion of both levers, it is important that β and γ on the long side be 90° or less.

During movement, when lifting a load, the cableway carriage 100 itself basically does not rise due to its own weight, and the lumber 200 also travels at a lag to the cableway carriage 100, and therefore motion according to the foregoing principles readily occurs.

In contrast, when lowering a load, the main cable 110 may slip downward by the distance that the rope 120 is driven or more due to the weight of the cableway carriage 100 itself. When the cableway carriage 100 slips downward, because the cableway carriage 100 is then ahead of the movement of the lumber 200, the trigger 60 then drops below the braking release starting point. Hence, the first lever 20 is no longer subject to the pressing force from the second lever 30 and rotates counterclockwise due to the action of a tensile force. Thus, the cableway carriage 100 is subjected to braking and the braking action comes into effect due to its slight slip downward. As a result of experimentation, it is ascertainable that braking generally comes into effect at about 10 to 20 cm. When, as mentioned earlier, the rope 120 is continuously driven starting from this braking state, the lumber 200 is pulled once again, and due to the trigger 60, the second lever 30 reaches the braking release starting point, thereby enabling the cableway carriage 100 to move as a load.

Furthermore, whether a load is being lifted or lowered, when a strong tensile force on the rope 120 is maintained at the moment an obstacle is exceeded, and when lowering is performed over a temporary steep surface, and so forth, the lumber 200 may fly ahead of the cableway carriage 100. Under such circumstances, the following operations ensue. When the lumber 200 is ahead of the cableway carriage 100, the rope 120 is pulled strongly. Hence, the first lever 20 is no longer subject to the pressing force from the second lever 30 and rotates counterclockwise due to the action of a tensile force. Thus, the cableway carriage 100 is subjected to braking and is secured. Therefore, the advancement of the lumber 200 suddenly stops and advancement is prevented beyond a certain point. Accordingly, because the lumber 200 is greatly prevented from advancing, the lumber 200 can be safely carried. Starting from this state, the lumber 200 is driven and braking is released by the trigger 60, thereby restarting movement.

After such carriage of the lumber 200 to the intended destination has ended, an unloading operation ensues as follows. The lumber 200 reaches the destination, the driving of the rope 120 is stopped, and when the lumber 200 drops slightly, the trigger 60 drops below the braking release starting point and the cableway carriage 100 is subjected to braking. When the tensile force on the rope 120 is relaxed in this state, the lumber 200 then drops to the degree that the tensile force is relaxed. Therefore, when the lumber 200 drops, unloading can be performed safely while the cableway carriage 100 remains secured.

Figure 6:
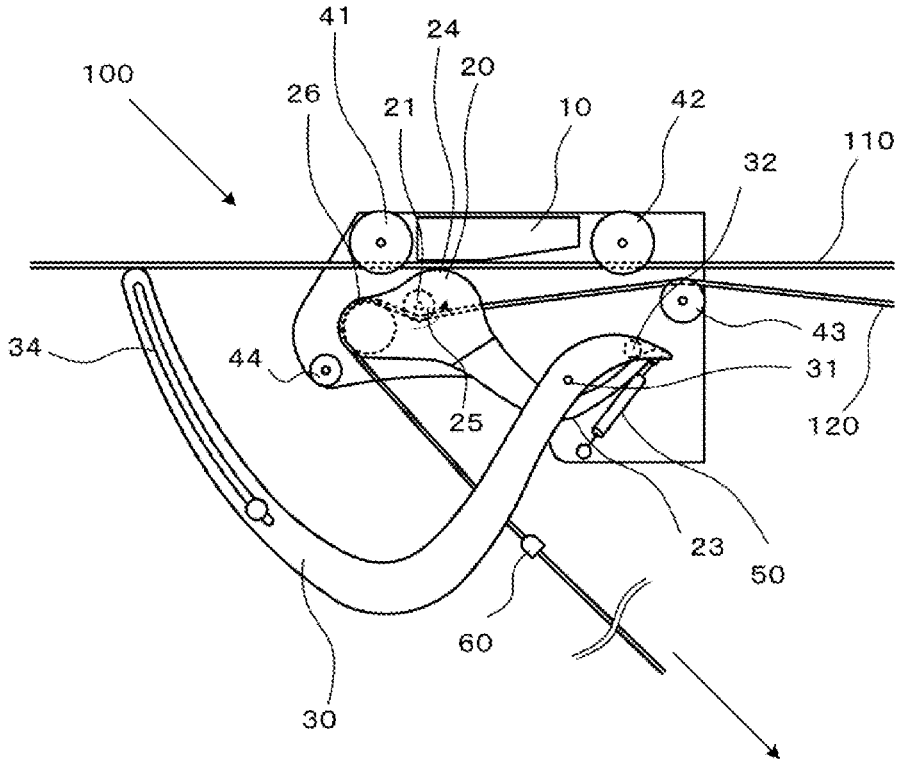
FIG. 6 is an explanatory diagram illustrating a usage state of the cableway carriage 100 according to the present embodiment.

In the case of the cableway carriage 100 according to the present invention, the weight of the load is likely applied from a direction other than a vertically downward direction at each stage, namely, loading, yarding movement, and unloading. However, when there is a load in the travel direction from a vertically downward direction, a force is reliably applied in a counterclockwise direction to the drive pulley 26 of the first lever 20, as illustrated in FIG. 6. Because the rope 120 is disposed between the two parallel plates of the second lever 30, the second lever 30 does not receive a force directly from the rope 120 in addition to the force from the trigger 60, and when the trigger 60 comes into contact with the second lever 30, the latter can reliably be made to rotate clockwise.

Figure 7:
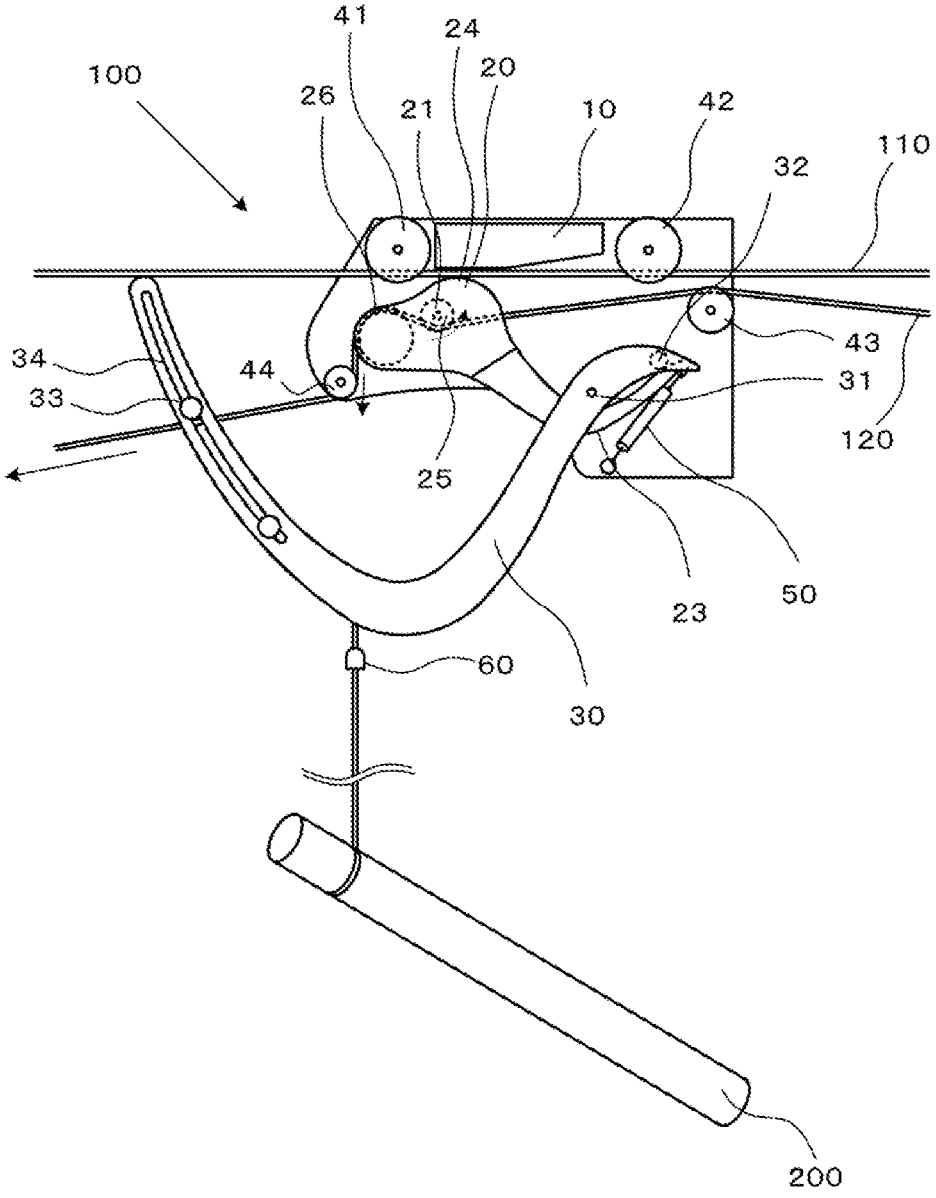
FIG. 7 is an explanatory diagram illustrating a usage state of the cableway carriage 100 according to the present embodiment.

However, when there is a load in the direction opposite to the travel direction from a vertically downward direction, because the drive pulley 26 is then pulled in a vertically downward direction by the correction base pulley 44 as illustrated in FIG. 7, a force is reliably applied in a counterclockwise direction to the drive pulley 26 of the first lever 20. Furthermore, because the second lever 30 is formed having two parallel plates, the main cable 110 and rope 120 can be passed therebetween without resistance. Hence, the second lever 30 can be prevented from receiving a force directly from the main cable 110 or rope 120 in addition to that from the trigger 60. Furthermore, even when there is an angle variation in the rope 120 due to load drag or the like, the rope 120 is prevented from disengaging from the second lever 30. When the second lever 30 is in a lower limit position, even when the load is conversely pulled from the direction opposite to the travel direction, the moving member 33 slides upward to prevent the second lever 30 receiving a force from the rope 120, thereby preventing detachment of the rope 120. Therefore, irrespective of the direction of the load pulling angle, which involves pulling in any direction between the vertical and the horizontal, until the trigger 60 presses the second lever 30, the second lever 30 does not exert a force on the first lever 20. Thus, the rope 120 can be drawn while the cableway carriage 100 remains secured. On the other hand, when the second lever 30 is in an upper limit position, the moving member 33 slides to the lower limit and the main cable 110 can be passed inside without resistance. Accordingly, the second lever 30 can be prevented from receiving a force, other than from the trigger 60, from either the main cable 110 or the rope 120.

As mentioned earlier, with the cableway carriage 100 according to the present invention, because the cableway carriage 100 can be prevented from dropping due to its own weight not only when a load is lifted but even when a load is lowered, same can also be suitably used for lowering a load.

Furthermore, even when a load suddenly flies in the travel direction or a load slips due to a steep slope, the cableway carriage 100 is subjected to braking, thereby enabling a load to be carried more safely.

Furthermore, the cableway carriage 100 according to the present invention has a disengagement prevention mechanism for the rope 120, and it is therefore possible, in a state where the cableway carriage 100 is secured, to also intercept a load in a horizontal direction other than the travel direction of the cableway carriage 100, that is, when the load is not under the main cable 110 line. In particular, because a load can be intercepted in the position in which the cableway carriage 100 is secured, by securing the cableway carriage 100 in the position desired for interception, carriage to substantially below the cableway carriage 100, which is in a preferable position, can be suitably performed.

Note that the present invention is not limited to or by the configurations of the embodiment, rather, changes may suitably be made within a scope not departing from the spirit of the present invention.

Although a case where lumber 200 is used as the load is described in the foregoing embodiment, a load other than lumber may also be used. The present invention may also be used for aerial carriage.

Figure 8:
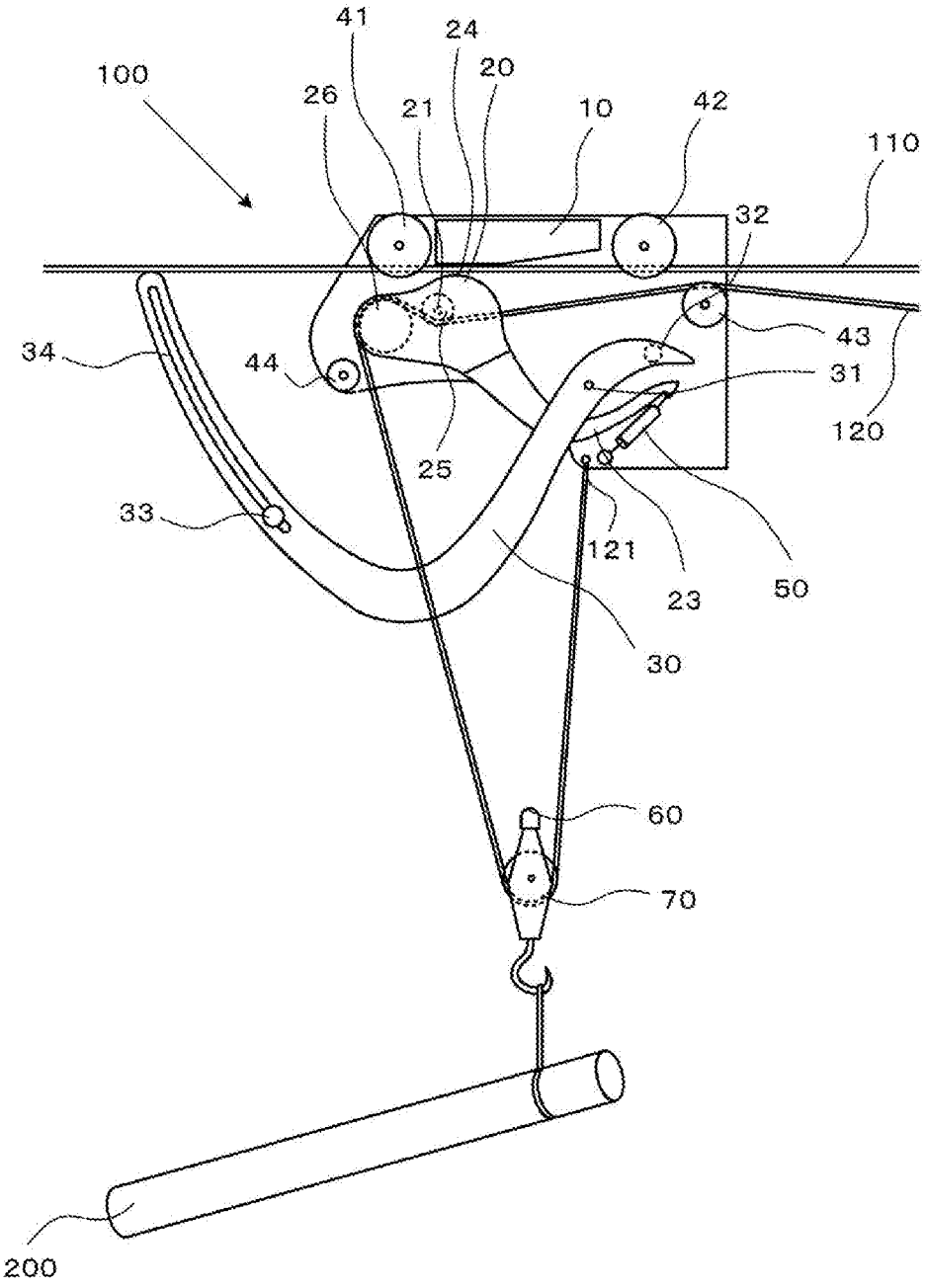
FIG. 8 is an explanatory diagram illustrating another embodiment of the cableway carriage 100 according to the present embodiment.

Furthermore, as illustrated in FIG. 8, an end 121 of the rope 120 may be secured to part of the base member 1 and pass a running block 70 midway therealong. By adopting this configuration, a load can be lifted using substantially half the force. At such time, the trigger 60 may be attached to the running block 70. Moreover, the tensile force in the winch from the cableway carriage 100 relative to the tensile force in the cableway carriage 100 from the load is 2:1, and because the cableway carriage 100 is drawn toward the load, it is hard for the cableway carriage 100 to be displaced toward the winch, there is half the tensile force on the rope 120, and the pressing forces of the two braking faces 11, 24 are also halved, thereby reducing the abrasion of the braking faces 11, 24.

INDUSTRIAL APPLICABILITY

As illustrated in the foregoing embodiment, the present invention can be utilized as a carrying tool for lumber and can be used for carrying loads in the fields of civil engineering, architecture, warehousing, and transportation.

REFERENCE SIGNS LIST

1 Base member
10 Main cable braking member
11 Braking face
11*a* Braking face part
20 First lever
21 First fulcrum
23 Bow-shaped part
24 First lever braking face
24*a* First lever braking face part
25 First pulley
26 Drive pulley
30 Second lever
31 Second fulcrum
32 First lever pressing part
33 Moving member
34 Groove
41 First base pulley
42 Second base pulley
43 Third base pulley
44 Correction base pulley
50 Biasing member
60 Trigger
70 Running block
100 Cableway carriage
110 Main cable
120 rope
121 End
200 Lumber

The invention claimed is:

1. A cableway carriage for carrying a load by utilizing a cableway that has a main cable, and a rope including a trigger, the cableway carriage comprising:

a base member;

a main cable braking member that has a braking face that comes into contact with the main cable and that is secured to the base member;

a first lever that has a first fulcrum serving as a center of rotation and provided to the base member, a first lever braking face provided in a position facing the braking face, a biasing member that biases the first lever braking face in a direction of separation from the braking face, and a drive pulley capable of applying a force in the direction in which the first lever braking face is brought close to the braking face by the tensile force of the rope; and a second lever that has a second fulcrum secured to the base member and serving as a center of rotation, and a first lever pressing part capable of pressing the first lever in the direction in which the first lever braking face is separated from the braking face, wherein, when the trigger, which indicates that the load has reached a predetermined height, presses the second lever, the second lever causes the first lever to separate the first lever braking face from the braking face.

2. The cableway carriage according to claim 1, wherein the second lever has a surface with which the trigger comes into contact that is formed having a convex, curved surface.

3. The cableway carriage according to claim 1, wherein at least a portion of the second lever is formed as two parallel plates between which the first lever is arranged in an intersecting manner.

4. The cableway carriage according to claim 1, wherein at least a portion of the second lever is formed as two parallel plates between which the rope is arranged.

5. The cableway carriage according to claim 1, wherein the second lever is configured such that a moving member for preventing the rope from disengaging from the second lever is slidably attached in the longitudinal direction of the second lever.

6. The cableway carriage according to claim 1, wherein the braking face is provided to a member that is exchangeable for the main cable braking member.

7. The cableway carriage according to claim 1, wherein the first lever braking face is provided to a member that is exchangeable for the first lever.

8. The cableway carriage according to claim 1, comprising, below the drive pulley:

a correction base pulley that, even when the rope is driven by a load in a direction opposite to the travel direction, corrects the line of the rope with respect to the drive pulley to the direction in which force is applied to the first lever in the direction in which the first lever braking face is brought close from the braking face.

* * * * *